US010434374B2

(12) United States Patent
Berggren et al.

(10) Patent No.: US 10,434,374 B2
(45) **Date of Patent: *Oct. 8, 2019**

(54) SPORTS BALL

(71) Applicant: NIKE, Inc., Beaverton, OR (US)

(72) Inventors: Scott R. Berggren, Portland, OR (US); Michelle J. Deaton, West Linn, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/194,930

(22) Filed: Nov. 19, 2018

(65) Prior Publication Data

US 2019/0083859 A1 Mar. 21, 2019

Related U.S. Application Data

(63) Continuation of application No. 15/444,755, filed on Feb. 28, 2017, now Pat. No. 10,207,158.

(51) Int. Cl.

| | |
|---|---|
| ***A63B 41/08*** | (2006.01) |
| ***A63B 45/02*** | (2006.01) |
| ***A63B 45/00*** | (2006.01) |
| ***A63B 43/00*** | (2006.01) |

(52) U.S. Cl.

CPC ..... *A63B 41/08* (2013.01); *A63B 43/008* (2013.01); *A63B 45/00* (2013.01); *A63B 45/02* (2013.01)

(58) Field of Classification Search

CPC ..... A63B 43/002; A63B 41/08; A63B 45/00; A63B 43/008; A63B 43/02

See application file for complete search history.

(56) References Cited

U.S. PATENT DOCUMENTS

| | | | | |
|---|---|---|---|---|
| 4,318,544 A * | 3/1982 | Brine, Jr. | ..... | A63B 41/08 40/327 |
| 5,310,178 A * | 5/1994 | Walker | ..... | A63B 41/08 273/DIG. 8 |
| 5,354,053 A * | 10/1994 | Ratner | ..... | A63B 41/08 264/245 |
| 5,427,372 A * | 6/1995 | Ratner | ..... | A63B 41/08 156/147 |
| 5,931,752 A * | 8/1999 | Guenther | ..... | A63B 41/08 473/597 |

(Continued)

*Primary Examiner* — Steven B Wong

(74) *Attorney, Agent, or Firm* — Quinn IP Law

(57) ABSTRACT

A sports ball comprising a cover having an outer substrate surface is provided. The cover may include plurality of panels, wherein each panel has a respective panel surface. The panel surfaces of the respective panels collectively comprise the outer substrate surface of the cover. A surface texture is disposed upon and additively applied to the outer substrate surface. The surface texture is disposed on the respective panel surfaces in customizable, panel-specific, predefined panel arrangements. The surface texture defines surface profile that includes an alternating and repeating series of land areas and raised portions, wherein each raised portion is positioned between a plurality of land areas. The raised portions extend from the outer substrate surface and are formed from a dimensional ink, wherein each of the plurality of raised portions has a terminus that is spaced apart from the outer substrate a height of greater than about 0.05 millimeters (mm).

19 Claims, 7 Drawing Sheets

(56) References Cited

U.S. PATENT DOCUMENTS

| | | | | | |
|---|---|---|---|---|---|
| RE37,468 | E | * | 12/2001 | Kennedy | A63B 41/08 473/596 |
| D540,408 | S | * | 4/2007 | Laliberty | D21/713 |
| D543,250 | S | * | 5/2007 | Laliberty | D21/713 |
| D620,060 | S | * | 7/2010 | Gibson | D21/713 |
| D645,101 | S | * | 9/2011 | Krysiak | D21/713 |
| 8,529,386 | B2 | * | 9/2013 | Nuernberg | A63B 41/08 40/327 |
| 10,207,158 | B2 | * | 2/2019 | Berggren | A63B 43/008 |
| 2004/0121865 | A1 | * | 6/2004 | Lee | A63B 41/08 473/597 |
| 2006/0046879 | A1 | * | 3/2006 | Kelly | A63B 41/08 473/603 |
| 2006/0211527 | A1 | * | 9/2006 | Guenther | A63B 41/08 473/597 |
| 2009/0325744 | A1 | * | 12/2009 | Raynak | A63B 41/085 473/604 |
| 2010/0248873 | A1 | * | 9/2010 | Cooper | A63B 41/08 473/599 |
| 2014/0100067 | A1 | * | 4/2014 | Swiszcz | A63B 41/08 473/603 |
| 2015/0031482 | A1 | * | 1/2015 | Frank | A63B 43/002 473/597 |
| 2015/0045159 | A1 | * | 2/2015 | Tompkins | A63B 41/08 473/596 |

* cited by examiner

SPORTS BALL

CROSS-REFERENCE TO RELATED APPLICATIONS

This application is a continuation of and claims the benefit of U.S. Non-provisional patent application Ser. No. 15/444,755, filed Feb. 28, 2017, which is hereby incorporated by reference in their entirety.

TECHNICAL FIELD

The disclosure relates to sports balls and a method of manufacturing and forming the same.

BACKGROUND

A variety of sports balls, for example, soccer balls, conventionally include a casing and an interior. The casing forms an exterior portion of the sports ball and is generally formed from a plurality of durable and wear-resistant panels joined together along abutting edge areas (e.g., with stitching or adhesives), i.e., via a seam. Designs such as decorative elements and holistic textural patterns may be applied to the exterior surface of the casing. Decorative elements are conventionally applied via processes such as thermal transfer films or a release paper. Textural patterns are conventionally applied via processes such as embossing, debossing, stamping, molding, or laser etching.

The casing may include an inner layer or intermediate structure that forms a middle portion of the sports ball and is positioned between the casing and the interior.

SUMMARY

A sports ball and method of manufacturing the same are provided. The sports ball includes a cover having an outer substrate surface. The cover may be comprised of a plurality of panels coupled via at least one seam. Each panel may have a respective panel surface that forms a portion of the outer substrate surface, such that collectively the panel surfaces comprise the outer substrate surface of the cover.

A surface texture, formed of a dimensional ink, is disposed upon the outer substrate surface and is disposed on each panel surface in a customizable predefined panel arrangement. The predefined panel arrangements on each of the respective panel surfaces collectively form a topographical design across the outer substrate surface of the cover.

The surface texture defines a surface profile that includes an alternating and repeating series of land areas and raised portions, wherein each raised portion is positioned between a plurality of land areas. The raised portions extend from the outer substrate surface and are formed from the dimensional ink. Each raised portion has a terminus that is spaced apart from the outer substrate surface by a height of greater than about 0.05 millimeters (mm).

The sports ball may be formed via the method of manufacturing disclosed herein, which includes the following steps: providing a cover; selecting a predefined panel arrangement; additively applying a dimensional ink in the selected predefined panel arrangement to the outer substrate surface of the cover via an additive manufacturing process.

The above features and advantages, and other features and advantages, of the present teachings are readily apparent from the following detailed description of some of the best modes and other embodiments for carrying out the present teachings, as defined in the appended claims, when taken in connection with the accompanying drawings.

DETAILED DESCRIPTION

Figure 1:
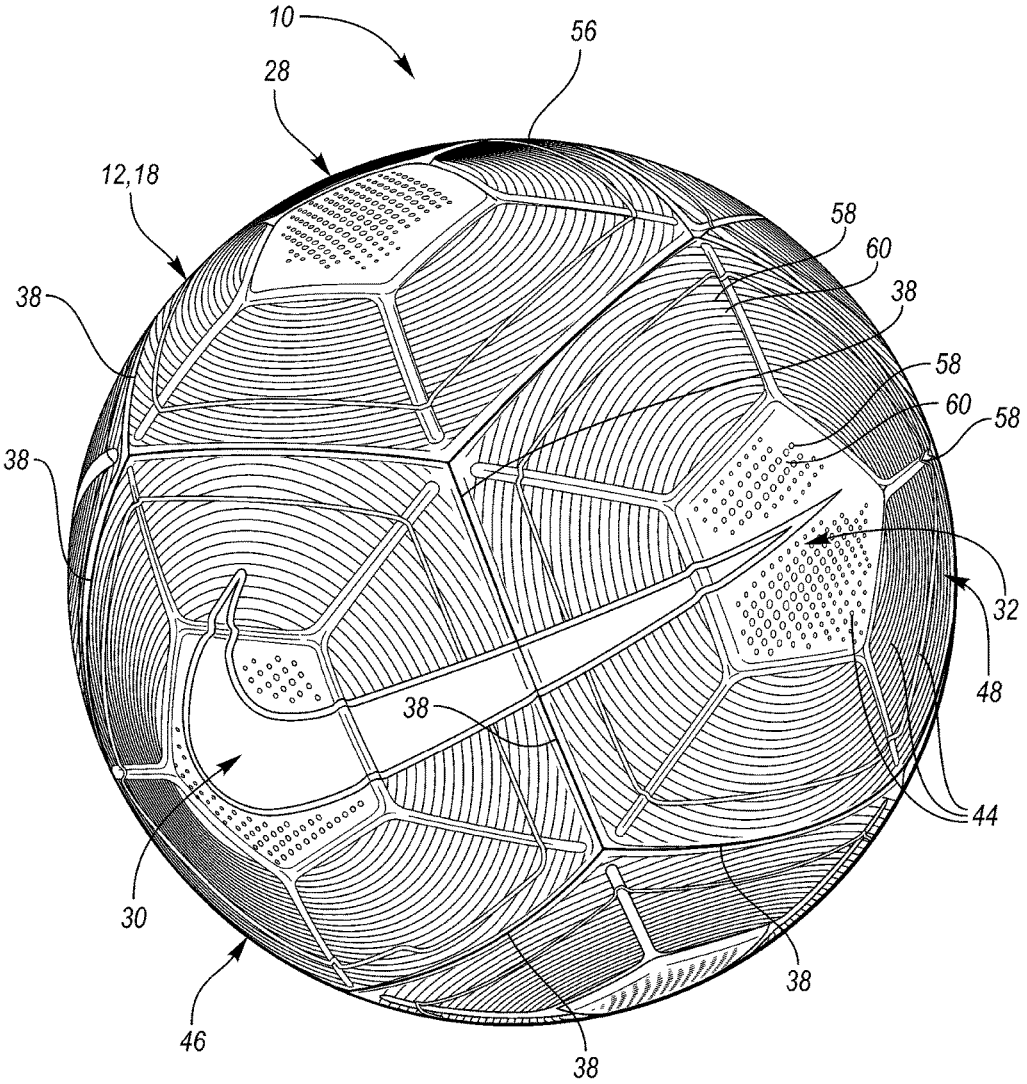
FIG. 1 is a schematic perspective view of an example sports ball with a topographical design formed on the outer substrate surface with a surface texture of dimensional ink.

While the present disclosure may be described with respect to specific applications or industries, those skilled in the art will recognize the broader applicability of the disclosure. Those having ordinary skill in the art will recognize that terms such as "above," "below," "upward," "downward," etc., are used descriptively of the figures, and do not represent limitations on the scope of the disclosure, as defined by the appended claims. Any numerical designations, such as "first" or "second" are illustrative only and are not intended to limit the scope of the disclosure in any way.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

The terms "A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

Features shown in one figure may be combined with, substituted for, or modified by, features shown in any of the figures. Unless stated otherwise, no features, elements, or limitations are mutually exclusive of any other features, elements, or limitations. Furthermore, no features, elements, or limitations are absolutely required for operation. Any specific configurations shown in the figures are illustrative only and the specific configurations shown are not limiting of the claims or the description.

The following discussion and accompanying figures disclose various sports ball configurations and methods relating to manufacturing of the sport balls. Although the sports ball is depicted as a soccer ball in the associated Figures, concepts associated with the configurations and methods may be applied to various types of inflatable sport balls, such as basketballs, footballs (for either American football or rugby), volleyballs, water polo balls, etc. and variety of non-inflatable sports balls, such as baseballs and softballs, may also incorporate concepts discussed herein.

Referring to the drawings, wherein like reference numerals refer to like components throughout the several views, a sports ball 10 and a method of manufacturing 100 the same are provided.

Figure 5:
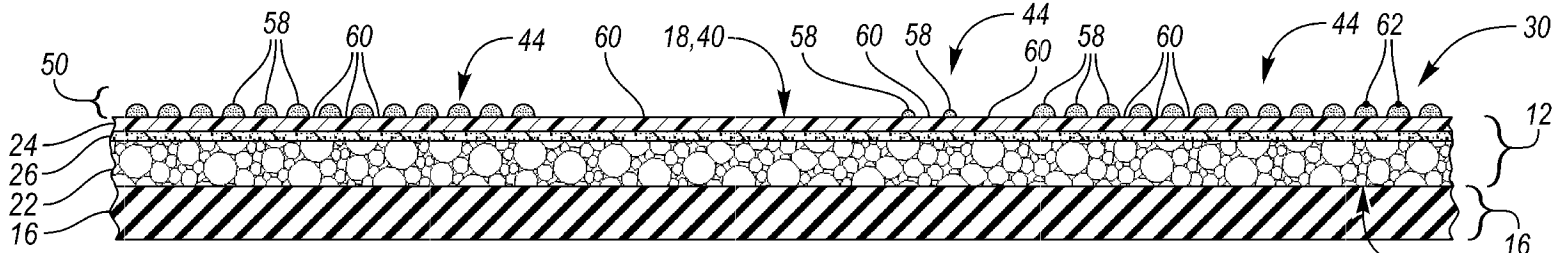
FIG. 5 is a schematic cross-section view of the first panel taken along line 5-5, wherein the surface texture disposed on the first panel surface in the first panel arrangement having a first surface profile.
Figure 6:
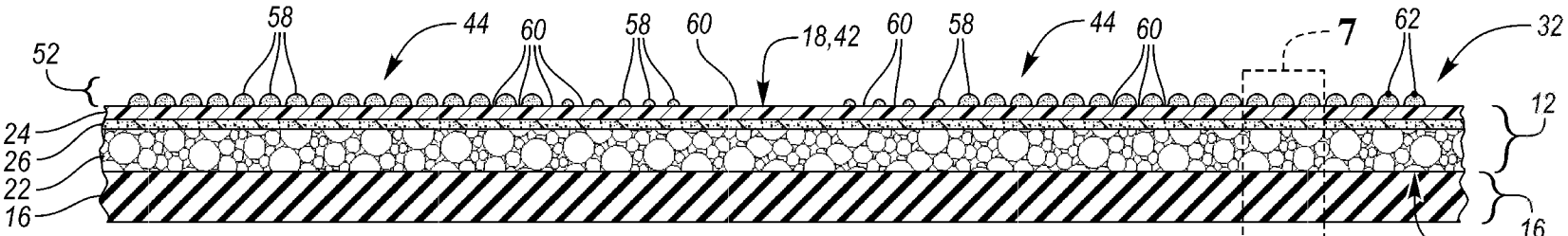
FIG. 6 is a schematic cross-section view of the second panel taken along line 6-6, wherein the surface texture disposed on the second panel surface in the second panel arrangement having a second surface profile.
Figure 7:
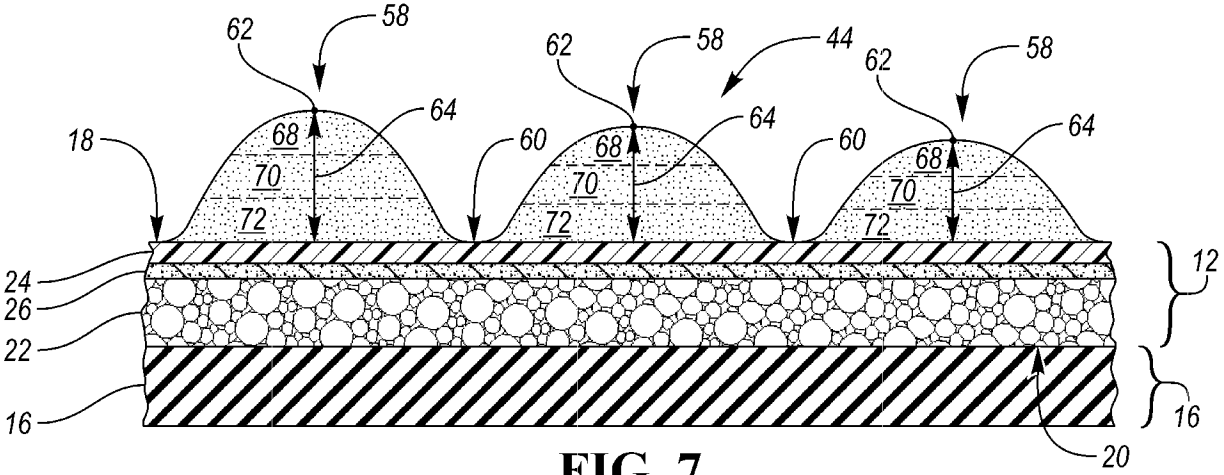
FIG. 7 is an enlarged, schematic, example cross-section view of a portion of FIG. 6.

As shown in FIG. 1, the sports ball 10 may be an inflatable sports ball such as a soccer ball or the like or a non-inflatable sports ball 10 such as a softball or the like. A sports ball 10 having the general configuration of a soccer ball is depicted in FIG. 1. The sports ball 10 may have a layered structure including a cover 12 and an interior 16 (FIGS. 5-7). The cover 12 forms an exterior portion of the sports ball 10. The interior 16 forms an interior portion of sports ball 10. The sports ball 10 may also include an intermediate structure located interior to the cover 12 between the cover 12 and the interior 16.

In a non-inflatable example configuration of the sports ball 10, the interior 16, may be one of a solid mass and hollow mass, fixed in size. In an inflatable example configuration of the sports ball 10, the interior 16 may be a bladder. In such an example configuration, in order to facilitate inflation (i.e., fill the interior with pressurized air), the interior 16 generally includes a valved opening that extends through the cover 12, and the intermediate structure, if present, thereby being accessible from the outer substrate surface 18 of the sports ball 10. Upon inflation, the bladder 16 is pressurized and the pressurization induces the sports ball 10 to take on a substantially spherical shape. More particularly, pressure within bladder 16 causes the bladder 16 to place an outward force upon the cover 12 on an inner substrate surface 20.

The cover 12 forms an exterior portion of the sport ball 10. As shown in FIGS. 5-7, the cover 12 includes the outer substrate surface 18, i.e., the exterior surface of the sports ball 10 and the inner substrate surface 20 opposite the outer substrate surface 18. The inner substrate surface 20 may be disposed adjacent to the ball interior 16. The cover 12 may be composed as a layered structure including an inner layer 22, an outer film 24, and a bonding material 26 disposed between the inner layer 22 and the outer film 24.

The inner layer 22 may include the inner substrate surface 20, wherein the inner substrate surface 20 is positioned adjacent to the ball interior 16. The inner layer 22 may be composed of a polymeric material, a polymer foam material, a foam material, textiles, or the like. Examples of suitable polymer materials include, but are not limited to, polyurethane, polyvinylchloride, polyamide, polyester, polypropylene, polyolefin, and the like. Examples of suitable polymer foam materials include, but are not limited to, polyurethane, ethylvinylacetate, and the like. Examples of suitable textile materials include, but are not limited to, a woven or knit textile formed from polyester, cotton, nylon, rayon, silk, spandex, or a variety of other materials. A textile material may also include multiple materials, such as a polyester and cotton blend. The inner layer 22 may further provide a softened feel to the sports ball, impart energy return, and restrict expansion of bladder 16, in an inflatable ball example.

The outer film 24 may be bonded to the inner layer 22 via the bonding material 26. The outer film 24 may be a polyurethane film or the like.

Figure 4:
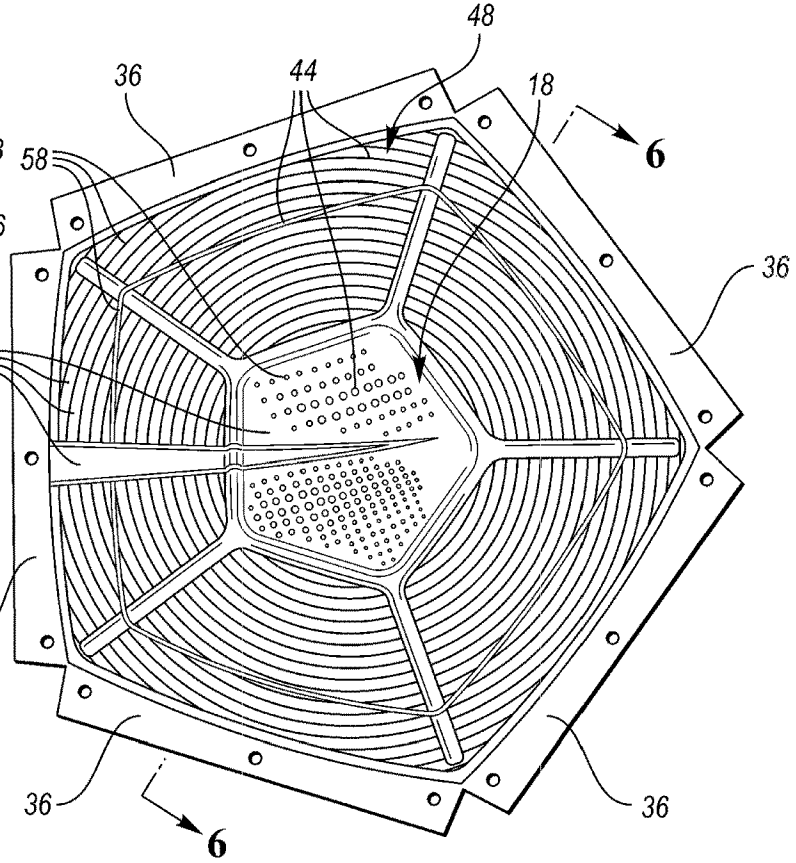
FIG. 4 is a schematic perspective view of a second panel, wherein the surface texture is formed on the second panel in a second panel arrangement.

As shown in FIGS. 1-4, the cover 12 may be generally formed by a plurality of panels 28, wherein each panel 28 has a respective panel surface that defines a portion of the outer substrate surface 18. The plurality of panels 28 includes a first panel 30 having a first panel surface 40 (FIG. 3) and a second panel 32 having a second panel surface 42 (FIG. 4). The respective panels 28 may be coupled together along abutting edge areas 36 (FIG. 2-4) via at least one seam 38 (FIG. 1). The panels 28 may be coupled along the abutting edge areas 36 with stitching, bonding, welding, adhesives, or another suitable coupling method. The cover 12, when part of an example soccer ball 10, may include various numbers of panels 28, such as the conventional eleven (11) panels or any other number of panels 28. The cover 12 may also exhibit a substantially uniform or unbroken configuration that does not include panels 28 joined at abutting edge areas 36 via seams 38, or includes fewer panels 28. In configurations, wherein a reduced number of panels are present or the ball 10 exhibits a substantially uniform or unbroken configuration, indentations or pseudo seams in the cover 12 may be positioned to impart the appearance of panels 28.

As illustrated throughout FIGS. 1-7, a surface texture 44 is disposed upon and additively applied to the outer substrate surface 18 of the cover 12. The surface texture 44 may form decorative or aesthetic elements upon the sports ball 10, display branding of the sports ball 10, via a logo contained therein, and may further be applied in such an orientation as to optimize grip at the point of contact with the user's hand and/or foot, or to improve aerodynamics during flight. The surface texture 44 may be disposed on a small portion of the outer substrate surface 18, on a single panel surface 40, 42 (FIGS. 3 and 4), on a select group of panel surfaces 40, 42, or upon a majority of the outer substrate surface 18 (FIG. 1).

The surface texture 44 may be comprised of a dimensional ink, and the dimensional ink may be additively applied to the respective panel surface 40, 42 in a predefined panel arrangement 46, 48, via an additive manufacturing process 104 further defined herein below and detailed in flow diagram form in FIG. 11. The predefined panel arrangement 46, 48 may cover a small portion of the respective panel surface 40, 42 and/or a majority of the respective panel surface 40, 42. Further, the predefined panel arrangement 46, 48 may vary by panel 28, 30, 32 and is further customizable by panel 28, 30, 32 e.g., each panel may include a unique surface texture 44 design or predefined panel arrangement 46, 48 additively applied to the respective panel surface 40, 42 via an additive manufacturing process 104. Said another way, the surface texture 44 need not be uniform across the majority of the outer substrate surface 18 or uniform across an entire panel surface 40, 42 as is often the case with surface textures formed on the outer substrate surface 18 of sports balls 10 by methods such as embossing, debossing, stamping, release paper, or the like.

Figure 3:
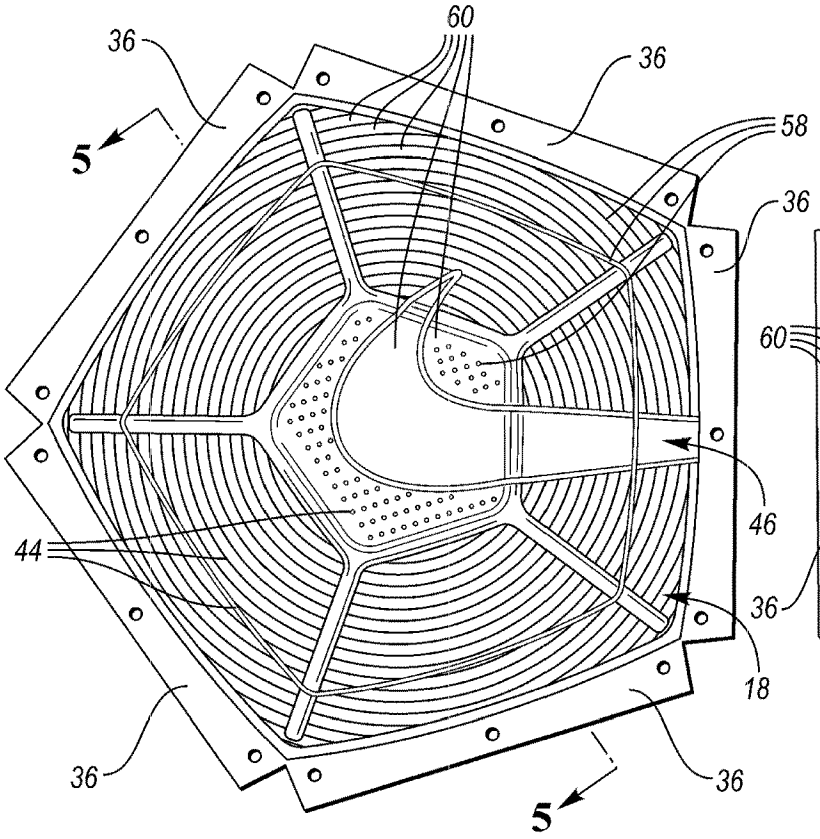
FIG. 3 is a schematic perspective view of a first panel, wherein the surface texture is formed on the first panel in a first panel arrangement.

Referring, for example, to FIGS. 3 and 4, the surface texture 44 is arranged in a first predefined panel arrangement 46 on the first panel surface 40 (FIG. 3) and the surface texture 44 is arranged in a second predefined panel arrangement 48 on the second panel surface 42 (FIG. 4). As shown in FIGS. 3 and 4, the second predefined panel arrangement 48 may be different than the first predefined panel arrangement 46.

Referring back to FIG. 1, the predefined panel arrangements 46, 48 of each of the plurality of panels 28, 30, 32 may collectively form a topographical design 56 across the outer substrate surface 18 of the cover 12 when the panels 28 are coupled via the at least one seam 38. The topographical design 56 may take many forms, for example, the topographical design 56 may include, but is not limited to, a series of concentric shapes, as shown in FIG. 1 as concentric circles. The topographical design 56 may also include, but is not limited to, a series of raised polygonal shapes; a series of raised letters; a series of raised stars; a waffle-type pattern; a series of raised angular designs, raised triangular designs positioned in a stacked or repeating format, and/or raised caret-type designs positioned in a stacked or repeating format; and other unique and abstract designs or patterns.

Each unique predefined panel arrangement 46, 48 maintains a unique surface profile 50, 52. For example, as shown in FIGS. 3-6, the first predefined panel arrangement 46 shown in FIG. 3 has a first surface profile 50 or cross-section shown in FIG. 5, and the second predefined panel arrangement 48 shown in FIG. 4 has a second surface profile 52 or cross-section shown in FIG. 6. When the first predefined panel arrangement 46 is different than the second predefined panel arrangement 48, as shown in FIGS. 3 and 4, the first surface profile 50 shown in FIG. 5 is different that the second surface profile 52 shown in FIG. 6.

As shown generally in FIGS. 5-7 the respective surface profiles 50, 52 comprise a plurality of raised portions 58 that extend from the outer substrate surface 18 and a plurality of land areas 60 that are flush with the outer substrate surface 18 and disposed between each of the plurality of raised portions 58. The surface profile 50, 52 of the respective panel 46, 48 may include an alternating and repeating series of the land areas 60 and the raised portions 58, wherein each raised portion 58 is positioned between a plurality of land areas 60.

The land areas 60 may maintain the same coloration as the outer substrate surface 18 or may be coated or colored a different color than the outer substrate surface 18 via the additive manufacturing process 100. Each of the plurality of raised portions 58 has a terminus 62 that is spaced apart from the outer substrate surface 18 by a height 64 that is greater than about 0.05 millimeters (mm). In one example embodiment, the height 64 may be from about 0.07 millimeters (mm) to about 0.15 millimeters (mm). In another example, the height 64 is about 0.11 millimeters (mm). In such examples, it is beneficial for the height 64 to be at least 0.05 millimeters (mm) and less than 0.15 millimeters (mm) in order to enhance playability of the ball 10. Raised portions 58 having heights 64 in the aforementioned range allow for visibility of the respective panel arrangements 46, 48 and overall topographical design 56, while also exhibiting the desired grip or contact between a user and/or player's hand or foot and the exterior surface of the ball 10 while still allowing the ball 10 to maintain desired aerodynamic and flight characteristics.

Each of the plurality of raised portions 58 are formed from a dimensional ink. The dimensional ink may be a resin-based ink, a puff ink, a water-based ink, a water-based silicone ink, or the like suitable for additive manufacturing and/or dimensional printing via the additive manufacturing process 100. More particularly, the dimensional ink may be a hybrid ink containing a polyurethane resin component and a puff ink component. The dimensional ink may also include an organic compound such as Cyclohexanon $(CH_2)_5CO$. The dimensional ink may also include a Polyurethane powder to add texture to the ink.

In one example embodiment, the dimensional ink may include a polyurethane resin component in a concentration or percentage-based amount of from about 15% to about 25%, a puff ink component in a concentration or percentage-based amount of less than about 7%, and a Cyclohexanon $(CH_2)_5CO$ component in a concentration or percentage based amount of from about 65% to about 80%. In such an example, the viscosity of the dimensional ink may be from about 300 decipascalsecond (dpa·s) to about 400 dpa·s, the percentage of solid content may be from about 25% to about 30%, and the Volatile Organic Compounds (VOCs) may be from about 710 g/L to about 770 g/L.

The dimensional ink may be clear in color such that the dimensional ink is transparent or translucent. The dimensional link also may be pigmented to a predetermined coloration. In example embodiments, wherein a colored ink is desired, the Polyurethane resin component of the dimensional ink will be composed of from about 45% to about 99% of white-colored polyurethane resin and from about 1% to about 65% polyurethane resin of at least one desired color other than white. The colored polyurethane resin may include multiple colors of resin, such that the predetermined mixture produces the predetermined and/or desired coloration.

Referring to FIG. 7, each raised portion 58 may be composed of a single layer of dimensional ink that spans the entire height 64 from the outer substrate surface 18 to the terminus 62. Each raised portion 58 may, alternatively, be composed of a plurality of layers 68, 70, 72 of dimensional ink, which together span the entire height 64 from the outer substrate surface 18 to the terminus 62. In an example embodiment, in which the raised portions 58 are composed of a plurality of layers 68, 70, 72 each of the plurality of layers may be composed of a dimensional ink of a particular color different than the remaining layers, the layers may repeat a color pattern, e.g., alternating colors, or the plurality of layers may all be composed of a dimensional ink of the same color, for example a clear dimensional ink. In one example embodiment, wherein the raised portions 58 are composed of a plurality of layers 68, 70, 72, shown by example in FIG. 7, the plurality of layers may include a first layer 68, a second layer 70, and a third layer 72. The third layer 72 of dimensional ink may be positioned between the outer substrate surface 18 and the second layer 70. The second layer 70 may be positioned between the third layer 72 and the first layer 68. The first layer 68 may be disposed between the second layer 70 and the terminus 62.

The second layer 70 and third layer 72 may be of a dimensional ink of a first color. The first layer 68 may be composed of a dimensional ink of a second color. The first color and the second color may be the same, or the second color may be different than the first color.

The third layer 72 may be composed of a dimensional ink of a first color, the second layer 70 may be composed of a dimensional ink of a second color, and the first layer 68 may composed of a dimensional ink of a third color. The first color may be the same as the second color and the third color. The first color may be that same as the second color and different than the third color. The first color may be the same as the third color and different than the second color. The first color may be different than each of the second color and the third color.

In an example embodiment wherein the at least one of the second layer 70 and third layer 72 are composed of a dimensional ink that is different in color than the first layer 68, each raised portion 58 may practically be utilized as a wear indicator. In one example embodiment, the second layer 70 and third layer 72 may be composed of a dimensional ink of a first color and the first layer 68 may be composed of a dimensional ink of a second color that is different than the first color and defines the predetermined color for the surface texture 44 within the respective predefined panel arrangement 46, 48 and the overall topographical design 56 apparent to the user upon purchase and initial play.

As the example sports ball 10 experiences wear through use and game play via contact with the hand and/or foot of the user, the first layer 68 of the second color may wear away, thereby exposing the second layer 70 of a first color in localized areas. As such, the exposure of the second layer 70 of a first color to the user would indicate that the sports ball 10 is worn and the manufacturer recommends replacement. Such wear indications could also be utilized as a training and consistency tool for the user. The manufacturer could also utilize the wear indicator tool to unveil designs on the second layer 70 not apparent at purchase; such that the user or player is essentially rewarded with newly revealed designs for consistent use of the sports ball 10.

Referring to FIGS. 8-11, the sports ball 10 may be manufactured via the method of manufacturing 100 disclosed herein. The present method 100 of manufacturing the sports ball 10 may include four general steps 101-104, as shown in flow diagram form in FIG. 10.

At step 101, a cover 12 is provided. As detailed herein above, the cover 12 has an outer substrate surface 18, i.e., the exterior surface of the sports ball 10 and an inner substrate surface 20 opposite the outer substrate surface 18. As shown in FIGS. 1-4, the cover 12 may be generally formed of a plurality panels 28, 30, 32, wherein each panel 28, 30, 32 has a respective panel surface 40, 42 that defines a portion of the outer substrate surface 18.

Figure 2:
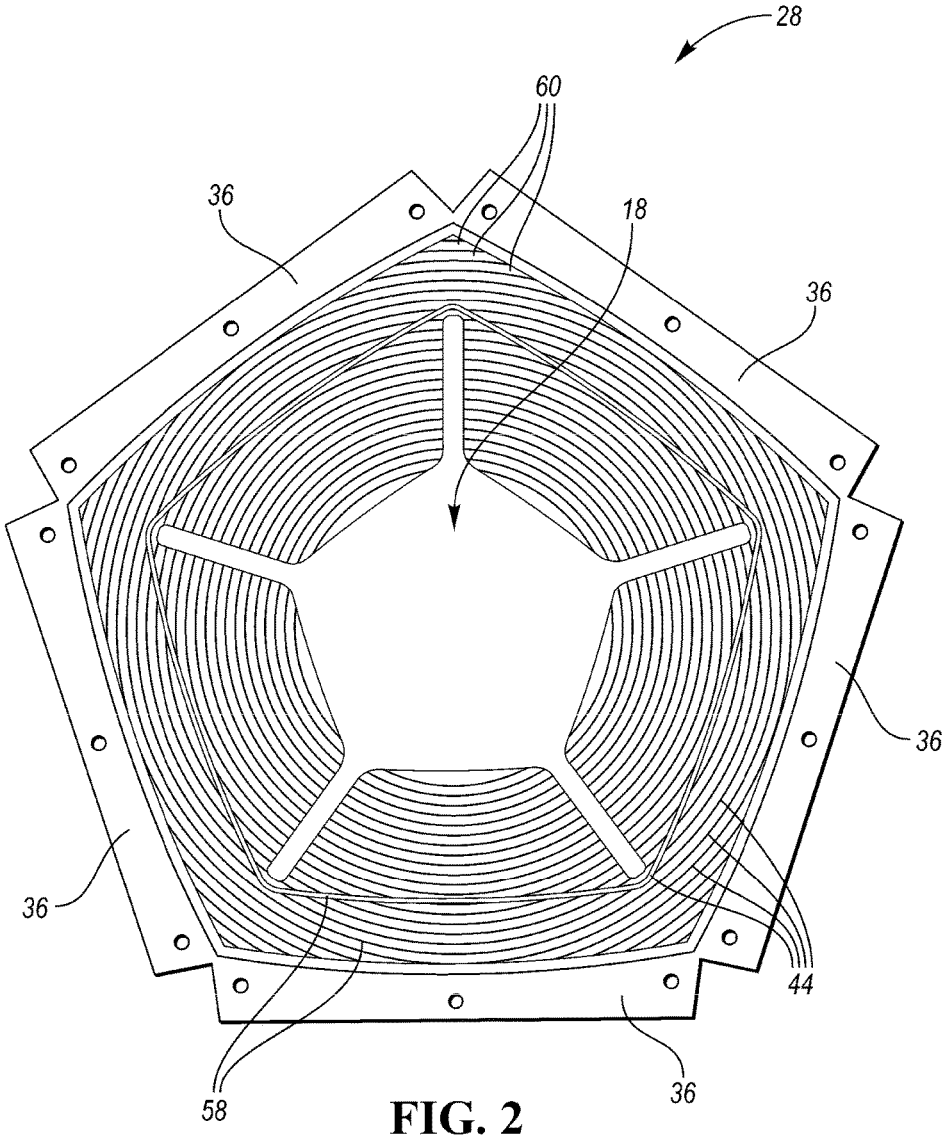
FIG. 2 is a schematic plan view of a respective panel.

At step 102, a predefined panel arrangement 46, 48 for the surface texture 44, shown by example in FIGS. 2, 3, and 4, is selected for each respective panel 28, 30, 32. For example, the first panel arrangement 46 (FIG. 3) may be selected for the first panel 30 and the second predefined panel arrangement 48 (FIG. 4) may be selected for the second panel 32. As shown in FIGS. 3 and 4, the second predefined panel arrangement 48 may be different than the first predefined panel arrangement 46. Further, the predefined panel arrangements 46, 48 may collectively form a topographical design 56 across the outer substrate surface 18 of the cover 12 when the panels 28 are coupled together.

Each unique predefined panel arrangement 46, 48 maintains a unique surface profile 50, 52. For example, as shown in FIGS. 3-6, the first predefined panel arrangement 46 shown in FIG. 3 has a first surface profile 50 or cross-section shown in FIG. 5, and the second predefined panel arrangement 48 shown in FIG. 4 has a second surface profile 52 or cross-section shown in FIG. 6. When the first predefined panel arrangement 46 is different than that second predefined panel arrangement 48, as shown in FIGS. 3 and 4, the first surface profile 50 shown in FIG. 5 is different that the second surface profile 52 shown in FIG. 6.

As shown generally in FIGS. 5-7 the respective surface profiles 50, 52 comprise a plurality of raised portions 58 that extend from the respective panel surface and a plurality of land areas 60 that are flush with the respective panel surface and disposed between each of the plurality of raised portions 58. The surface profile 50, 52 of the respective panel 28, 30, 32 may include an alternating and repeating series of the land areas 60 and the raised portions 58, wherein each raised portion 58 is positioned between a plurality of land areas 60. Each of the plurality of raised portions 58 has a terminus 62 that is spaced apart from the respective panel surface by a height 64 that is greater than about 0.05 millimeters (mm). In one example embodiment, the height 64 may be from about 0.07 millimeters (mm) to about 0.15 millimeters (mm). In another example the height is about 0.11 millimeters (mm).

At step 103, optionally, a base ink may be applied in the predefined panel arrangement 46, 48 to the respective panel surface 40, 42, such that the base ink is disposed between the respective panel surface 40, 42 and the dimensional ink that forms the surface texture 44. The base ink may be a primer that is designed to create a better bond between the dimensional ink and the respective panel surface 40, 42. The base ink may have a viscosity from about 80 decipascalsecond (dpa·s) to about 200 dpa·s and the Volatile Organic Compounds (VOCs) may be from about 700 g/L to about 900 g/L.

The base ink may be applied via a silk screening process or the like. The base ink may be applied to the respective panel surface 40, 42 via an immersion tool 94 controlled by an automated print apparatus 91, shown in FIG. 9, and discussed herein in more detail with respective to steps 201-203 of step 104. The base ink may be applied in multiple layers, such that the immersion tool 94 completes at least one stroke or pass over the respective panel surface 40, 42 for each base ink layer application. For example, the base ink may be applied in two (2) layers, wherein the immersion tool 94 completes two (2) strokes or passes in association with each base ink layer application, i.e., totaling four (4) immersion tool 94 strokes or passes of the respective panel surface 40, 42.

At step 104, the dimensional ink is additively applied in the predefined panel arrangement 46, 48 to the respective panel surface of at least one of the plurality of panels 28, 30, 32 via an additive manufacturing process. If a base ink is applied to the respective panel surface 40, 42 at step 103, the base ink is disposed between the respective panel surface and the dimensional ink. As such, the dimensional ink forms the surface texture 44 disposed on the panel surface 40, 42 of the respective panel 28, 30, 32 in the selected predefined panel arrangement 46, 48. The additive manufacturing process is a process by which the three dimensional (3D) design data of the respective selected predefined panel arrangement 46, 48 is used to build up a component, i.e., the raised portions 58 of the surface texture 44 in layers by depositing material, i.e., the dimensional ink. Suitable additive manufacturing processes include, but are not limited to silk screen printing, 3D printing, additive layer manufacturing, stereolithography, and the like.

Figure 11:
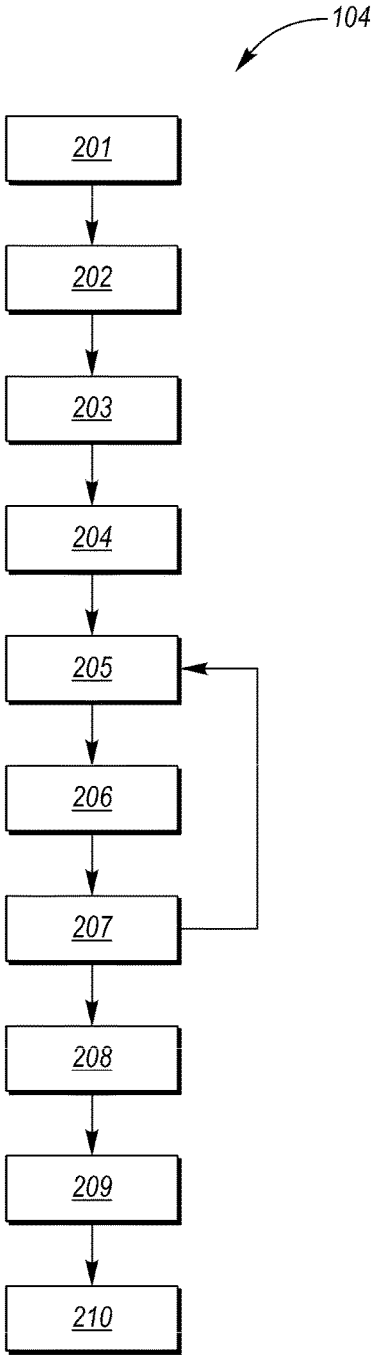
FIG. 11 is a flow diagram further detailing the step of additively applying a dimensional ink, in a selected predefined panel arrangement, to the panel surface of at least one of the plurality of panels via an additive manufacturing process.

Step 104, additively applying a dimensional ink to the panel surface of at least one of the plurality of panels 28, 30, 32 via an additive manufacturing process is further detailed in FIG. 11. Particularly, step 104 of additively applying a dimensional ink to the panel surface 40, 42 of at least one of the plurality of panels 28, 30, 32 via an additive manufacturing process includes several sub-steps detailed in flow diagram form FIG. 11 as steps 201-210.

Figure 8:
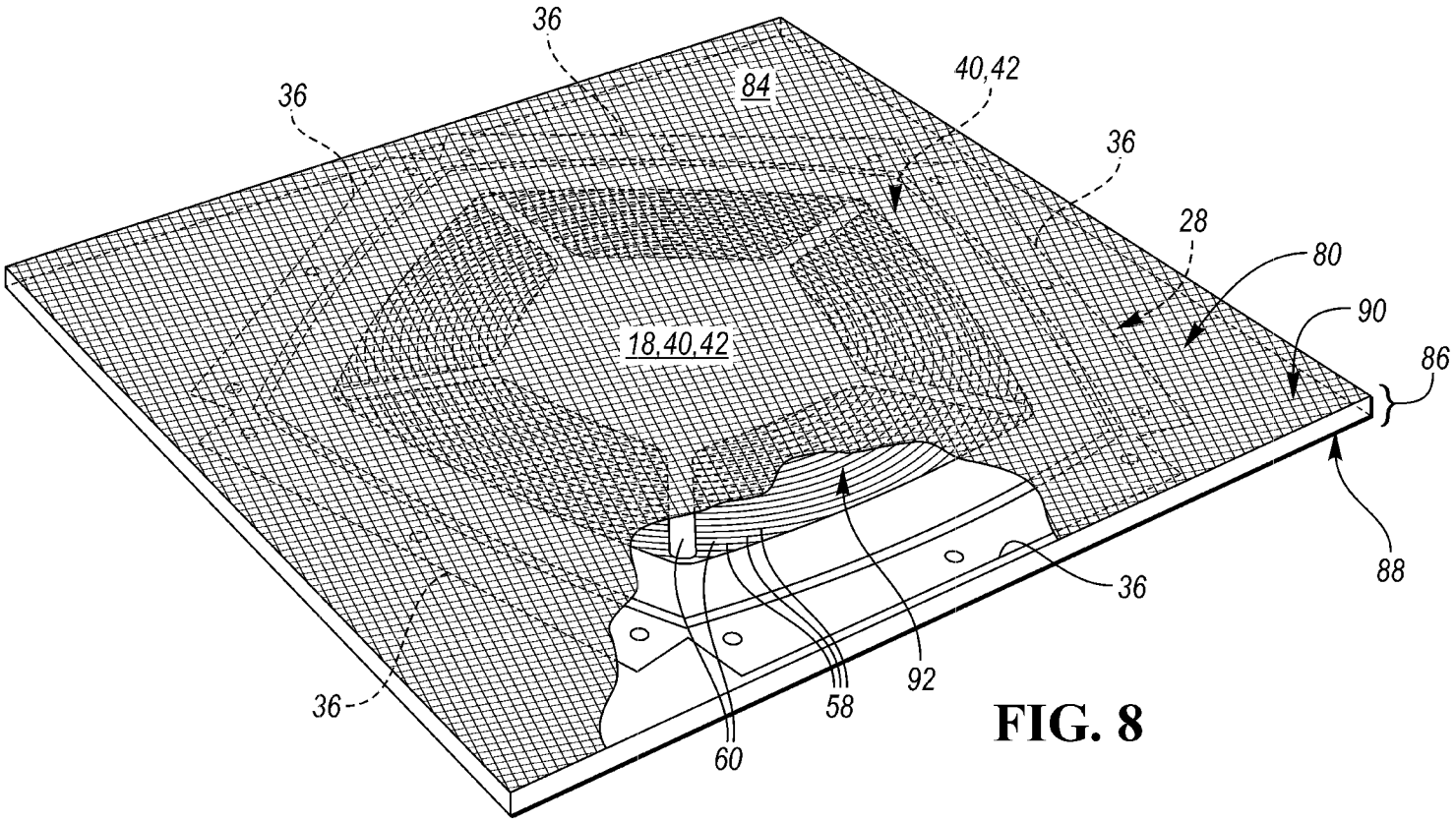
FIG. 8 is a schematic perspective view of a screen positioned over an example panel.
Figure 9:
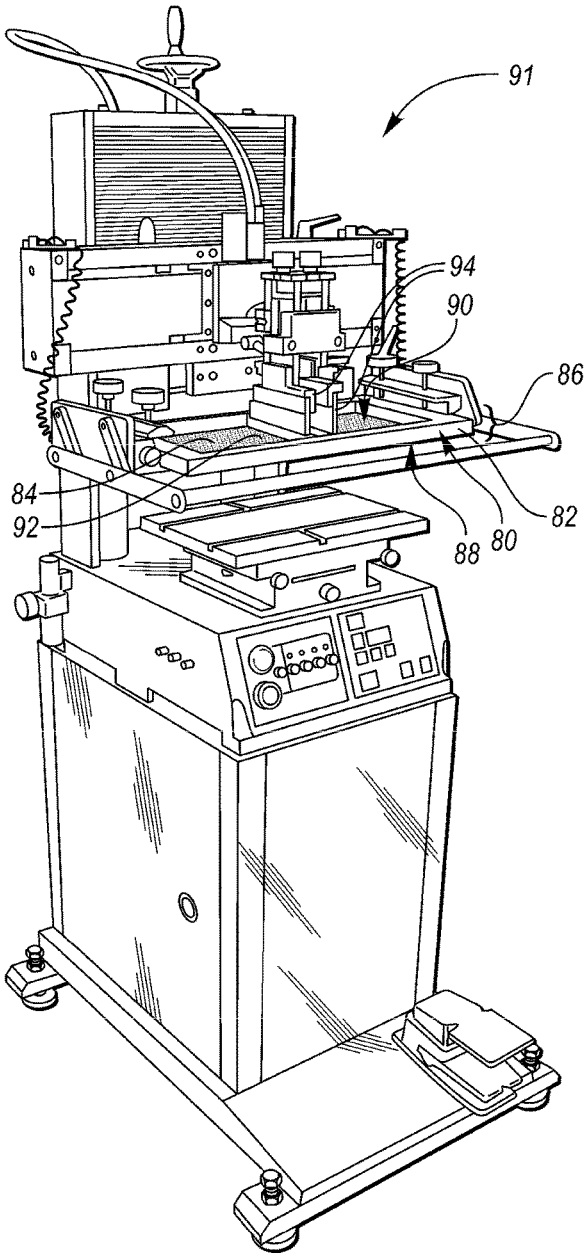
FIG. 9 is a schematic perspective view of an example additive manufacturing apparatus.
Figure 10:
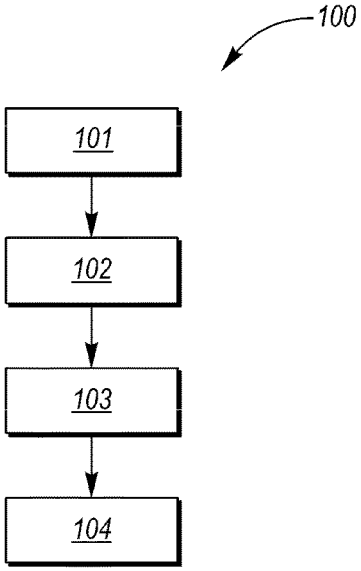
FIG. 10 is a flow diagram detailing the method of manufacturing the sports ball.

At step 201, a screen 80 is positioned over the respective panel 28, 30, 32 or portion of the cover 12, such that the respective panel surface faces the screen 80, as shown in FIG. 8. Referring further to FIGS. 8 and 9, the screen 80 may have a substrate side 88 positioned adjacent to the panel surface and an open side 90 positioned opposite the substrate side 88. The screen 80 may have a frame 82 and an interior mesh portion 84. The interior mesh portion 84 may be contained within the frame 82 and may have a thickness 86. The thickness 86 of the interior mesh portion 84 is determined by the height 64 of the raised portions 58 within the selected predefined panel arrangement 46, 48. In accordance with the example embodiment detailed herein above, the thickness 86 is greater than about 0.05 millimeters (mm). The thickness 86 must be greater than the height 64, as the interior mesh portion 84 of the screen 80 and the respective panel surface define an inkwell 92 configured to receive the dimensional ink to form the surface texture 44 in the form of the selected predefined panel arrangement 46, 48.

The interior mesh portion 84 may be blocked with a blocking stencil in areas of the selected predefined panel arrangement 46, 48 that do not include surface texture 44, such that the dimensional ink is restricted from entering the inkwell 92 and proceeding to the respective panel surface in such areas. Said another way, the dimensional ink is only allowed to pass through the screen 80, into the inkwell 92, and onto the respective panel surface in the areas not blocked by the blocking stencil.

At step 202, the inkwell 92 is flooded a first application of the dimensional ink. At step 203, and as shown in FIG. 9, the open side 90 of the screen 80, within the frame 82, is traversed by an immersion tool 94 controlled by an automated print apparatus 91. As the immersion tool 94 traverses the open side 90 of the screen 80, the first application of dimensional ink, flooded into the inkwell 92 at step 202, is compressed and distributed through the interior mesh portion 84 of the screen 80, into the inkwell 92, and on to the respective panel surface. In one example, the immersion tool 94 may complete two (2) strokes or passes of the open side 90 of the screen 80 to compress and distribute each application of dimensional ink, including the first application of dimensional ink.

At step 204, an intermediate curing process is initiated for the first application of the dimensional ink. The curing procedure for the dimensional ink may be one of time drying, heated curing or drying, or the like. In one example, the first application of dimensional ink is cured via a time drying process, such that the first application of dimensional ink cures for a time period of from about three (3) minutes to about five (5) minutes.

At step 205, the inkwell 92 is flooded with a subsequent application of dimensional ink. At step 206, the open side 90 of the screen 80, within the frame 82, is traversed by the immersion tool 94 controlled by the automated print apparatus 91. As the immersion tool 94 traverses the open side 90 of the screen 80, the subsequent application of dimensional ink, flooded into the inkwell 92 at step 205, is compressed and distributed through the interior mesh portion 84 of the screen 80, into the inkwell 92, and on to the respective panel surface. In one example, the immersion tool 94 may complete two (2) strokes or passes of the open side 90 of the screen 80 to compress and distribute each application of dimensional ink, including the subsequent application of dimensional ink.

At step 207, an intermediate curing process is initiated for the subsequent application of the dimensional ink. The curing procedure for the dimensional ink may be one of time drying, heated curing or drying, or the like. In one example, the subsequent application of dimensional ink is cured via a time drying process, such that the subsequent application of dimensional ink cures for a time period of from about three (3) minutes to about five (5) minutes.

As shown in FIG. 11, steps 205-207 may be repeated until the height 64 of the respective raised portions 58 is greater than 0.05 millimeters (mm), and, preferably, from about 0.07 millimeters (mm) to about 0.15 millimeters (mm).

In one example embodiment, wherein the height 64 is designed to be about 0.11 millimeters (mm), steps 205-207 are completed twice, such that the ink well 92 is flooded first with the first application of dimensional ink, second with a subsequent application of dimension ink, i.e., a second application of dimensional ink, and third with another subsequent application of dimensional ink, i.e. a third application of dimensional ink.

In this example, the dimensional ink may applied in layers, as shown in FIG. 7, such that the third layer 72, positioned between the outer substrate surface 18 or respective panel surface and the second layer 70, corresponds to the first application dimensional ink; the second layer 70, positioned between the third layer 72 and the first layer 68, corresponds to the second application of dimensional ink; and the first layer 68, positioned between the second layer 70 and the terminus 62, corresponds to the third application of dimensional ink. In the same example, with each application of dimensional ink or application of each layer, the immersion tool 94 completes two (2) passes or strokes across the open side 90 of the screen 80 be ink layer 68, 70, 72, for a total of six (6) passes or strokes.

The first application of dimensional ink and the second application of dimensional ink may consist of a dimensional ink of a first color, such that the second layer 70 and the third layer 72 are likewise composed of a dimensional ink of a first color. The third application of dimensional ink may consist of a dimensional ink of a second color, such that the first layer 68 is likewise composed of a dimensional ink of a second color. The first color may be different than the second color or the first color and second color may be the same.

Similarly, the first application of dimensional ink may be composed of dimensional ink of a first color, such that the third layer 72 is a first color. The second application of dimensional ink may be composed of a dimensional ink of a second color, such that the second layer 70 is likewise composed of a dimensional ink of a second color. The third application of dimensional ink may consist of a dimensional ink of a third color, such that the first layer 68 is likewise composed of a dimensional ink of a third color. The first color may be the same as the second color and the third color. The first color may be that same as the second color and different than the third color. The first color may be the same as the third color and different than the second color. The first color may be different than each of the second color and the third color.

Referring back to FIG. 11, following the application and curing of the dimensional ink in steps 202-207, at step 208 the screen 80 may be removed from the respective panel surface.

At step 209, an exterior coating may be applied to the cover 12, i.e., the respective panel surfaces of each panel of the plurality of panels 28, 30, 32 and the surface texture 44 defined by the dimensional ink. The exterior coating may be applied via a silk-screening process or the like. The exterior coating may have a viscosity from about 60 decipascalsecond (dpa·s) to about 120 dpa·s and the Volatile Organic Compounds (VOCs) may be from about 825 g/L to about 870 g/L. The exterior coating may be water-based with a solid content percentage of from about 15% to about 17%.

At step 210, a final curing process is initiated for the exterior coating. The curing procedure for the exterior coating may be one of time drying, heated curing or drying, or the like.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

The invention claimed is:

1. A sports ball comprising:

a cover having an outer substrate surface; and a surface texture disposed upon the outer substrate surface, wherein the surface texture includes a plurality of raised portions that extend from the outer substrate surface, wherein each of the plurality of raised portions has a terminus that is spaced apart from the outer substrate surface by a height that is greater than about 0.05 millimeters (mm);

wherein each raised portion is composed of a plurality of layers of a dimensional ink disposed upon the outer substrate surface; and wherein the plurality of layers of dimensional ink extend from the outer substrate surface to the terminus, along an entirety of the height of each raised portion.

2. The sports ball of claim 1 wherein the height is from about 0.07 millimeters (mm) to about 0.15 millimeters (mm).

3. The sports ball of claim 2 wherein the height is about 0.11 millimeters (mm).

4. The sports ball of claim 1 wherein the surface texture is disposed upon a majority of the outer substrate surface of the cover.

5. The sports ball of claim 1 wherein the surface texture forms a topographical design across the outer substrate surface of the cover.

6. The sports ball of claim 5 wherein the topographical design defines a wear indicator formed of dimensional ink.

7. The sports ball of claim 6, wherein the plurality of layers includes:

a first layer;

a second layer being positioned between the outer substrate surface and the first layer;

wherein the first layer is composed of a dimensional ink of a second color and the second layer is composed of a dimensional ink of a first color; and wherein the first color is different than the second color.

8. The sports ball of claim 5 wherein the topographical design defines a logo formed of dimensional ink.

9. The sports ball of claim 5 wherein the topographical design defines a series of letters formed of dimensional ink.

10. The sports ball of claim 5 wherein the topographical design defines a plurality of polygons formed of dimensional ink.

11. The sports ball of claim 5 wherein the topographical design defines a point of contact indicator for a user formed of dimensional ink.

12. The sports ball of claim 5 wherein the cover comprises of a plurality of panels coupled via at least one seam, and wherein each panel has a respective panel surface that defines a portion of the outer substrate surface, such that the surface texture is disposed on each panel surface in a predefined panel arrangement.

13. The sports ball of claim 12 wherein the surface texture covers a majority of the respective panel surface of each panel.

14. The sports ball of claim 13 wherein the plurality of panels includes a first panel and a second panel;

wherein the surface texture is arranged in a first panel arrangement on the panel surface of the first panel, and wherein the surface texture of the first panel arrangement defines a first surface profile; and wherein the surface texture is arranged in a second panel arrangement on the panel surface of the second panel, and wherein the surface texture of the second panel arrangement defines a second surface profile.

15. The sports ball of claim 14 wherein the second panel arrangement is different than the first panel arrangement, and wherein the first surface profile is different than the second surface profile.

16. The sports ball of claim 15 wherein the predefined panel arrangements of each of the plurality of panels collectively form the topographical design across the outer substrate surface of the cover.

17. The sports ball of claim 16 wherein the plurality of panels includes four panels.

18. The sports ball of claim 17 wherein the sports ball further includes an interior bladder disposed within the cover.

19. The sports ball of claim 18 wherein the cover further includes:

an outer layer defining the outer substrate surface; and an intermediate structure, the intermediate structure comprising:

a first intermediate layer formed of a polymer foam material and disposed adjacent to the outer substrate layer; and a second intermediate layer disposed between the first intermediate layer and the interior bladder.

* * * * *